US008997492B2

(12) United States Patent
Bonati et al.

(10) Patent No.: US 8,997,492 B2
(45) Date of Patent: Apr. 7, 2015

(54) APPARATUS AND METHOD FOR REHEATING TURBINE STEAM

(71) Applicant: Balcke-Durr GmbH, Ratingen (DE)

(72) Inventors: Guido Bonati, Dusseldorf (DE); Gerd Stuckenschneider, Essen (DE)

(73) Assignee: Balcke-Durr GmbH, Ratingen (DE)

( * ) Notice: Subject to any disclaimer, the term of this patent is extended or adjusted under 35 U.S.C. 154(b) by 122 days.

(21) Appl. No.: 13/745,007

(22) Filed: Jan. 18, 2013

(65) Prior Publication Data

US 2014/0026576 A1 Jan. 30, 2014

(30) Foreign Application Priority Data

Jan. 20, 2012 (DE) ..... 10 2012 001 091

(51) Int. Cl.
*F01K 7/22* (2006.01)
*F01K 3/18* (2006.01)
*F01K 9/00* (2006.01)

(52) U.S. Cl.
CPC .. *F01K 3/18* (2013.01); *F01K 9/003* (2013.01)

(58) Field of Classification Search
USPC ..... 60/653, 677–679
See application file for complete search history.

(56) References Cited

U.S. PATENT DOCUMENTS

| | | | | |
|---|---|---|---|---|
| 3,574,303 | A | 4/1971 | Rabas | |
| 3,744,459 | A * | 7/1973 | Reed | 122/483 |
| 3,759,319 | A | 9/1973 | Ritland et al. | |
| 3,919,839 | A * | 11/1975 | Aguet | 60/39.182 |
| 4,015,562 | A | 4/1977 | Yousoufian | |
| 4,607,689 | A | 8/1986 | Mochida et al. | |
| 5,622,605 | A * | 4/1997 | Simpson et al. | 203/10 |
| 5,671,601 | A * | 9/1997 | Bronicki et al. | 60/641.5 |
| 2003/0000220 | A1 * | 1/2003 | Liebig et al. | 60/772 |

FOREIGN PATENT DOCUMENTS

| | | |
|---|---|---|
| DE | 2314732 A1 | 11/1973 |
| DE | 3445609 A1 | 6/1986 |

* cited by examiner

*Primary Examiner* — Hoang Nguyen
(74) *Attorney, Agent, or Firm* — Baker & Hostetler LLP

(57) ABSTRACT

The invention relates to an apparatus and a method for reheating turbine steam, comprising a reheater and a condensate collecting tank, into which condensate is guided from the reheater. A subcooler is provided upstream of the reheater in a common housing with the reheater. The subcooler is arranged beneath the reheater and the condensate collecting tank is connected with the subcooler in order to supply condensate from the condensate collecting tank as heating medium.

7 Claims, 3 Drawing Sheets

APPARATUS AND METHOD FOR REHEATING TURBINE STEAM

The invention relates to an apparatus for reheating turbine steam, comprising a reheater and a condensate collecting tank into which condensate from the reheater is guided. The invention further relates to a method for reheating turbine steam in a steam turbine process.

Such apparatuses and methods are used in a multistage steam turbine process of a steam power plant. They are frequently combined with a water separator and are used for drying the wet steam emitted by the high-pressure turbine and for reheating the steam depending on the process before its entrance into the medium-pressure or low-pressure turbine, which is known as reheating. In the case of solar power plants there are usually only two pressure stages. The energy required for reheating is taken as heating steam from the steam of a steam generator. Combined water separators and reheaters with a common pressure-proof tank in horizontal or vertical configuration are known from the prior art, in which two strictly separated circuits of heat-absorbing water or steam on the one hand and a heat-supplying medium on the other hand such as flue gas, helium, water or steam, or thermal oil or liquid salt in solar power plants that do not evaporate directly are arranged. Generic apparatuses have been disclosed in DE 23 14 732 A, DE 34 45 609 A1, U.S. Pat. No. 4,607,689 A, U.S. Pat. No. 4,015,562 A and U.S. Pat. No. 3,574,303 A.

The invention is based on the object of providing a method and an apparatus of the kind mentioned above which offers improved efficiency or leads to such improved efficiency.

According to the apparatus of the invention, this object is achieved in such a way that, upstream of the reheater in the direction of the turbine steam flow, a condensate subcooler is provided in a common housing with the reheater, that the condensate subcooler is connected with the condensate collecting tank in order to use the condensate from the condensate collecting tank for preheating the turbine steam, that the subcooler is arranged beneath the reheater, and that the condensate collecting tank is connected with the subcooler in order to supply condensate from the condensate collecting tank as a heating medium for preheating the turbine steam. Heating medium can be saved in this manner with the same temperature rise in comparison with a reheater without subcooler. The subcooler operates like a first reheater stage. A condensate pump can be omitted.

According to the method of the invention, the object is achieved in such a way that the condensate is diverted from the reheater to a condensate tank along the flow path of the heating steam in a reheater, wherein the diversion may occur at spaced positions along the flow path where the heating steam has different pressures. Condensate flows with different pressure levels can be guided through siphons into a common condensate tank. The condensate collected in the tank can be used by the subcooler as a heating medium for preheating turbine steam upstream of the steam-heated reheater bundle.

It is appropriate in the case of a horizontal configuration that the reheater is provided on the heating-steam side with a first outlet for condensate and downstream of the heating steam with a second outlet for condensate and scavenging steam, so that the heating steam is guided in four paths through the reheater bundle.

An especially advantageous further development of the invention is that the first and second outlet are connected with the condensate collecting tank, preferably according to the principle of the U-tube manometer. In this manner, the entire condensate quantity can be used for subcooling even in the case of several heating steam paths.

It is further advantageous that a water separator is arranged upstream of the subcooler.

In the case of a horizontal configuration, it is further advantageous that the reheater is arranged as high as possible and the subcooler is arranged as low as possible in the pressure-proof tank.

The method can be performed in an especially simple manner by supplying the diverted condensate to the condensate subcooler in freefall. A condensate pump can be omitted in this way. A condensate pump is provided in the case of a vertical configuration in order to supply condensate to the condensate subcooler.

In the case of horizontal configuration, the condensate diverted at different points is supplied according to the principle of the U-Tube manometer to the collecting tank from which the condensate will be discharged as heating medium.

The invention will be described below in closer detail by reference to an embodiment shown in the schematic drawings, wherein.

Figure 1:
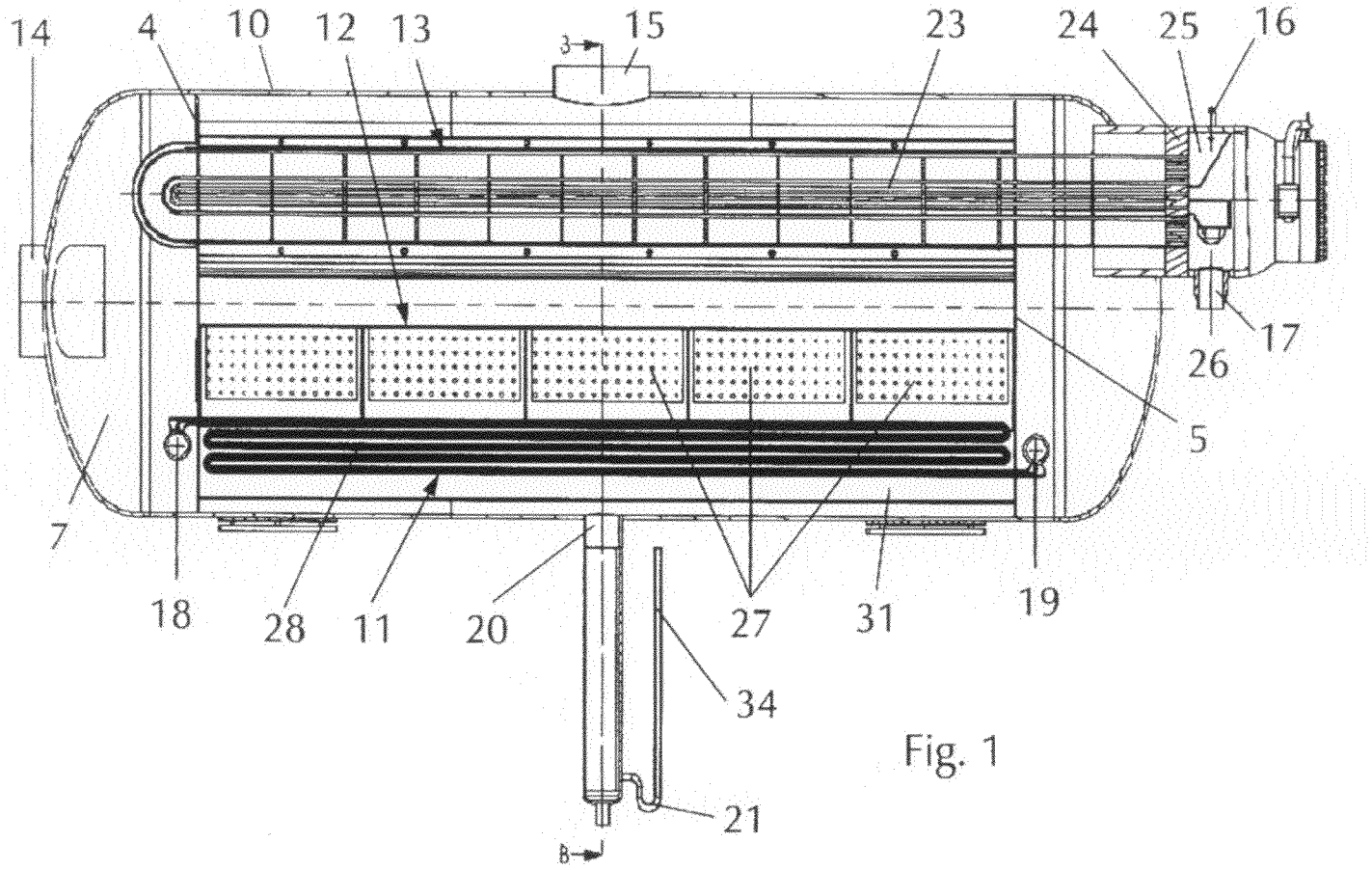
FIG. 1 shows a longitudinal sectional lateral view of a combined water separator and reheater.
Figure 2:
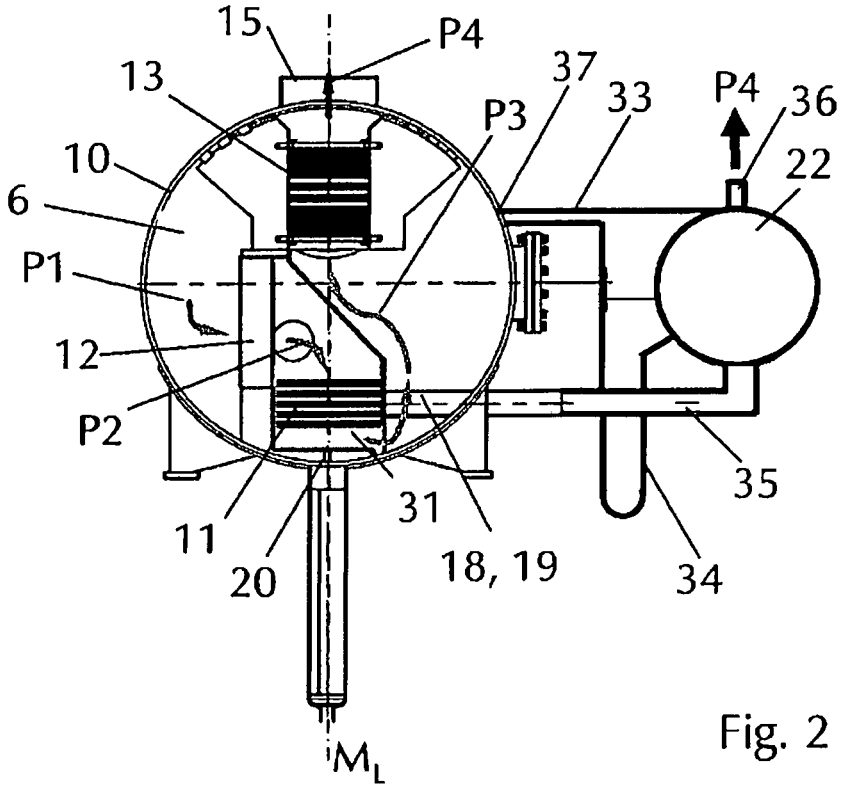
FIG. 2 shows a cross-section through the water separator and reheater according to FIG. 1 along a line of intersection B-B.

In accordance with FIGS. 1 and 2, a subcooler 11, a water separator 12 and a reheater 13 for turbine steam from the process circuit of a high-pressure steam turbine installation are arranged in a common pressure-proof cylindrical housing 10 of horizontal configuration. The subcooler 11 lies upstream of the reheater 13 and downstream of the water separator 12. The interior space of the housing 10 is subdivided in the longitudinal direction according to FIG. 1 into a working space and a distributor space, with both spaces being limited on one of the face sides of the housing 10 by an end wall 5. The distributor space assumes a face area 7 according to FIG. 1 and an area 6 which extends according to FIG. 2 over the remaining length of the tank 10 and which forms the inflow region of the water separator 12. It is sealed on the face side against the working space 8 by a separating wall 4 which is opposite of the end wall 5. Over the length of the housing 10, the area 6 of the distributor space extends along a lateral longitudinal wall of the housing 10 parallel to the working space. In the illustrated example it substantially assumes a lateral sector of the cylindrical housing 10.

The working space 8 substantially extends over the length of the housing 10 between the end wall 5 and the face wall 4. It comprises flow-conducting guide surfaces and separating walls, with which the turbine steam is guided successively through the water separator 12, the subcooler 11 and the reheater 13. The water separator 12 is disposed with respect to the longitudinal central plane $M_L$ of the housing 10 in a lateral region of the housing 10 along the inside of the distributor space 6. Two symmetrically arranged rows of water separators are also possible instead of the illustrated water separator 12. It is arranged in a laterally offset manner with respect to the longitudinal central plane $M_L$ and therefore laterally to the subcooler 11 and reheater 13 with respect to the longitudinal central plane $M_L$, with the subcooler 11 and the reheater 13 being arranged in an approximately symmetrical way with respect to the longitudinal central plane $M_L$ of the housing 10 in the bottom and upper region of the housing 10. The subcooler 11 is therefore disposed beneath the reheater 13 and laterally offset beneath the water separator 12. The reheater 13 is arranged in the illustrated example in the upper region of the housing 10 with the same lateral offset in relation to the water separator 12 as the subcooler 11. A similar lateral offset is not mandatory however.

Wet turbine steam, typically with a water fraction of approximately 2 to 16%, is introduced into the tank 10 via a turbine steam inlet 14 on a face side of the tank 10, which turbine steam exits from a high-pressure turbine (not shown). The turbine steam exits as reheated steam via an outlet 15 on the upper side of the housing after it was dried in the water separator 12 and was subsequently heated in the subcooler 11 and reheater 13.

Figure 3:
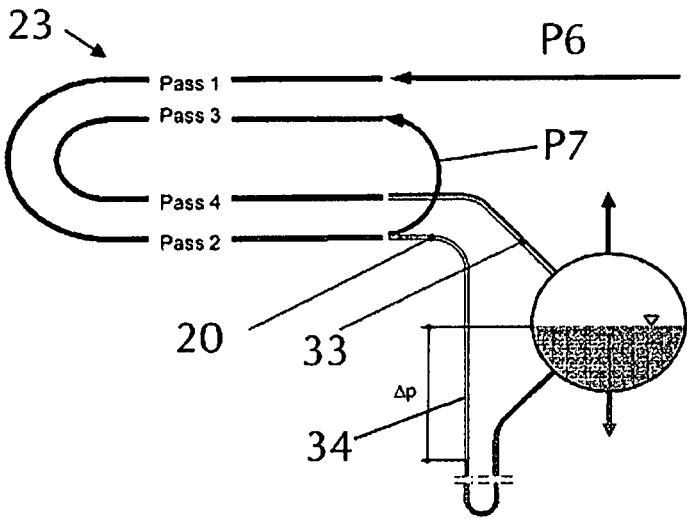
FIG. 3 shows an illustration of the steam guidance in the reheater according to FIG. 1 to FIG. 3.

A heat-supplying high-pressure or low-pressure pressure steam is supplied via a heating steam inlet 16 to the reheater 13. Condensate flows produced in the reheater 13 are supplied depending on the pressure either directly via the condensate line 33 or via condensate loops (e.g. 34) to a separate condensate collecting tank 22 outside of the housing 10 (FIG. 2, FIG. 3). In FIG. 1, the condensate collecting tank 22 is disposed in front of the housing 10 and in front of the intersecting plane and is therefore not shown. The reheater 13 comprises a bundle 23 of horizontally extending U-tubes, which extend over the entire length of the working space and whose ends are connected with a tube sheet 24. An inlet chamber 25 is situated behind the tube sheet 24, into which a heating steam inlet 16 opens, and, separated therefrom, an outlet chamber 26 with the outlet 17.

The water separator 12 consists of separator modules 27 with mechanical mist separators whose surfaces will intercept even the smallest drops, so that they can be joined and collected at the bottom. The separator modules 27 are arranged over the entire length of the working space. They form the connection between the distributor space 6 and the working space. Since the water separator 12 is arranged in a laterally offset manner with relation to the reheater 11, an outflow region of the dried turbine steam is disposed beneath the reheater 11.

The turbine steam is guided according to arrow P1 horizontally through the water separator 12. The water removed from the turbine steam in the water separator 12 reaches the bottom region and is discharged to the outside via a water outlet 20 in the bottom section of the tank 10. The same occurs with the water which collects on the inner surfaces of the tank in the distributor space and working space, with different pressure levels being compensated by condensate loops 21.

The subcooler 11 consists of a substantially horizontally extending tube bundle 28. It comprises a subcooler inlet 18 and a subcooler outlet 19, via which condensate is conducted from the condensate collecting tank 22 as a heating medium into the tube bundle 28 and is discharged from there as subcooled condensate. The tube bundle 28 extends according to FIG. 1 over the entire length of the working space 8. In accordance with FIG. 2, the subcooler 11 is arranged beneath the outflow region which is adjacently disposed on the side and downstream of the water separator 12. The outlet space is separated from the remaining working space 8 by a separating wall, which separating wall extends in the illustrated example from the upper edge of the water separator expanding in a funnel-like manner to the opposite edge of the subcooler 11, so that the flow of the dried turbine steam exiting from the water separator 12 can enter the cooler 11 in a flow-promoting manner according to arrow P2.

The subcooler 11 is open at the bottom, where a deflection space 31 is located which is open towards the side facing away from the water separator 12, so that the already reheated turbine steam exiting from the subcooler 11 according to arrow P3 is able to move in the remaining working space 8 laterally past the subcooler and along the separating wall upwardly to the reheater 13. The turbine steam then enters the reheater 13 from below, passes through said reheater from the bottom to top, is further reheated therein, and leaves the housing 10 according to the arrow P4. It is supplied from there to a low-pressure turbine (not shown).

The condensate collecting tank 22 is shown in the illustrated example as a cylindrical hollow body in horizontal position. In accordance with FIG. 2 and FIG. 3, the condensate collecting tank 22 is arranged at a height between the reheater 13 and the subcooler 11. The outlet 17 is connected with the condensate collecting tank 22 via a condensate loop which compensates the differential pressure between the second and fourth path. The outlet 37 of the fourth path of the reheater 13, which is connected directly with the condensate collecting tank 22, is situated at a higher level than the condensate level of the condensate collecting tank 22, and the outlet 35 of the condensate collecting tank 22 lies above or at least at the same level as the heating medium inlet 18. As a result of this arrangement, the condensate produced in the reheater 13 flows together with the remaining scavenging steam in freefall from the reheater 13 into the condensate collecting tank 22, and the collected condensate flows from the condensate collecting tank 22 in freefall to the subcooler 13 and flows through the subcooler 13. A pump is therefore not required for producing said flow. The scavenging steam flowing into the condensate collecting tank 22 is discharged to the outside via a steam outlet 36. The scavenging steam, which is also known as excess steam, is the part of the heating steam which does not condense in the reheater tubes and is necessary for condensate transport. Scavenging steam is only required in horizontal configuration. In the case of vertical configuration, condensate transport occurs by gravitation alone.

The use of siphon 34 allows guiding the condensate flows flowing in from the reheater 13 into the common condensate collecting tank 22 despite their different pressure levels without leading to any spontaneous evaporation in the condensate collecting tank 22 or causing transverse flows to the reheater 13. The pressure level in the condensate collecting tank 22 corresponds approximately to the pressure level at the outlet of the fourth path. The temperature of the condensate received in the condensate collecting tank 22 is obtained from the saturated steam temperature corresponding to the pressure. The subcooling of the condensate only occurs in the subcooler 11.

FIG. 3 illustrates the passage of the heating steam through the reheater 13 and the functional connections of the reheater 13 with the condensate collecting tank 22. The condensate is diverted at different points along the flow path of the heating steam in the reheater, with the diversion occurring at locations where the heating medium has different pressures. In the present example, the discharge of the condensate occurs at two locations with the pressures $p_{Pass\ 2}$ and $p_{Pass\ 4}$.

The heating steam flowing into the pipe bundle 33 according to arrow P6 successively passes through the paths Pass 1, Pass 2, Pass 3 and Pass 4, with said heating steam passing energy to the turbine steam coming from the subcooler 11 and heating said steam. When passing through the first tube loops Pass 1 and Pass 2, a fraction of the heating steam condenses under heating of the turbine steam, with a pressure loss occurring in the paths Pass 1 and Pass 2. The obtained condensate is discharged via the outlet 17 and reaches the condensate collecting tank 22 via the siphon 34. During further passage according to arrow P7, the heating steam heats the turbine steam further in the paths Pass 3 and Pass 4, with the steam condensing further and a pressure $p_{Pass\ 4}$ being obtained at the outlet of Pass 4. This condensate from the paths Pass 3 and Pass 4 reaches the condensate collecting tank 22 together with the scavenging steam via the condensate line 33. The pressure in the condensate collecting tank 22 corresponds to the pressure $p_{Pass\ 4}$ with the higher pressure no $p_{Pass\ 2}$ at the end of the second path being compensated by the condensate loop 34.

The pressure difference Δp between path 2 and path 4 corresponds to the difference between the height of the condensate head in the input-side tube siphon 34 and the height of the condensate level in the condensate collecting tank 22. The driving force for the through-flow of the subcooler is the geodetic height in the condensate collecting tank. Relief to a lower pressure level behind the subcooler promotes through-flow. It is not mandatory however. The condensate leaves the subcooler 11 as subcooled condensate via the heating medium outlet 19 and is discharged out of the housing 10 to the outside.

The invention claimed is:

1. An apparatus for reheating turbine steam, comprising a reheater and a condensate collecting tank into which condensate is guided from the reheater, characterized in that a condensate subcooler is provided upstream of the reheater in a common housing with the reheater, that the condensate subcooler is connected with the condensate collecting tank in order to use the condensate from the condensate collecting tank for preheating the turbine steam, that the subcooler is arranged beneath the reheater, and that the geodetic height in the condensate collecting tank is used for the flow through the subcooler.

2. The apparatus according to claim 1, characterized in that the reheater is provided on the heating-steam side with a first outlet for the condensate and downstream of the heating steam with a second outlet for condensate and scavenging steam.

3. The apparatus according to claim 1, characterized in that the excess steam from the condensate collecting tank is guided back to the turbine steam in order to increase efficiency.

4. The apparatus according to claim 1, characterized in that the condensate flows from the first and second outlet are transferred with different pressures to the common condensate collecting tank, with a tube siphon being used which operates according to the principle of the U-tube manometer.

5. The apparatus according to claim 1, characterized in that a water separator is arranged upstream of the subcooler relative to the direction of the turbine steam flow.

6. The apparatus according to claim 4, characterized in that in the case of a vertical configuration of the housing the reheater and the subcooler are arranged substantially symmetrically to a vertical longitudinal central plane ($M_L$) and the water separator is arranged in a laterally offset manner in relation to the vertical longitudinal central plane ($M_L$) of the housing, and that a condensate collecting pump is provided in order to supply condensate to the condensate subcooler.

7. The apparatus according to claim 4, characterized in that in the case of a horizontal configuration of the housing the reheater and the subcooler are arranged substantially symmetrically to the vertical central axis and the water separator is arranged in a laterally offset manner in relation to the vertical central axis of the housing.

* * * * *